United States Patent [19]

Savariego

[11] Patent Number: 4,796,161

[45] Date of Patent: Jan. 3, 1989

[54] ACTUATION DEVICE FOR A PLURALITY OF CHEMICAL LIGHT SOURCES

[76] Inventor: Meir Savariego, Moshav Nir Zvi, Israel

[21] Appl. No.: 114,112

[22] Filed: Oct. 27, 1987

[30] Foreign Application Priority Data

Nov. 4, 1986 [IL] Israel ..... 80486

[51] Int. Cl.[4] ..... F21K 2/00

[52] U.S. Cl. ..... 362/34; 362/209

[58] Field of Search ..... 362/34, 159, 249, 209, 362/394, 190, 191, 157, 228; 252/700

[56] References Cited

U.S. PATENT DOCUMENTS

| | | | |
|---|---|---|---|
| 3,576,987 | 5/1971 | Voight | 362/34 |
| 3,578,962 | 5/1971 | Gerber | 362/34 |
| 3,808,414 | 4/1974 | Roberts | 362/34 |
| 3,829,678 | 8/1974 | Holcombe | 362/34 |
| 3,875,602 | 4/1975 | Miron | 362/34 |
| 3,940,604 | 2/1976 | Rauhut | 362/34 |

*Primary Examiner*—Ira S. Lazarus
*Assistant Examiner*—D. M. Cox
*Attorney, Agent, or Firm*—Ladas & Parry

[57] ABSTRACT

Apparatus for providing selected coincident actuation of a plurality of chemical light sources to provide a relatively intense light source which is actuated at a precisely selectable time.

14 Claims, 2 Drawing Sheets

ACTUATION DEVICE FOR A PLURALITY OF CHEMICAL LIGHT SOURCES

FIELD OF THE INVENTION

The present invention relates to light sources and more particularly to chemical light sources.

BACKGROUND OF THE INVENTION

Various types of chemical light sources are known in the marketplace for providing visible and/or invisible light without requiring an electrical power source. Such light sources, which are also sold as amusements, normally find application in civilian and military markets for emergency operations and are normally used singly. The term "light sources" is used throughout to include sources of radiation in either or both visible and non-visible spectra, including thermal radiation sources.

Light sources of this type are commercially available from American Cyanamid Co. of Bound Brook, N.J., U.S.A. under the trademark "Safety Light" and under the product designation 9527501 and are described in U.S. Pat. Nos. 3,539,794; 3,576,987 and 3,597,362.

SUMMARY OF THE INVENTION

The present invention seeks to provide apparatus for providing selected coincident actuation of a plurality of chemical light sources to provide a relatively intense light source which is actuated at a precisely selectable time.

There is thus provided in accordance with a preferred embodiment of the present invention actuation apparatus for providing simultaneous actuation of a plurality of chemical light sources including apparatus for mounting a plurality of elongate chemical light sources which are actuable by bending thereof and light source engagement apparatus for selectable simultaneous bending engagement with the plurality of elongate chemical light sources for generally coincident actuation thereof.

In accordance with a preferred embodiment of the present invention, the apparatus for mounting includes apparatus for supporting the plurality of chemical light sources both at the base thereof and at an intermediate location thereof in a generally circular configuration about an axis.

Further in accordance with a preferred embodiment of the present invention, the light source engagement apparatus comprises an engagement element which is relatively locatable along the axis in a first engagement orientation relatively distant from the mounting apparatus at which location it engages the chemical light sources without causing bending thereof sufficient to cause actuation and in a second engagement orientation relatively closer to the mounting apparatus at which location it engages the chemical light sources so as to cause bending thereof sufficient to cause actuation thereof.

Additionally in accordance with a preferred embodiment of the invention spring loaded apparatus is provided for providing relative displacement between the mounting apparatus and the engagement element such that the engagement element shifts from the first engagement orientation to the second engagement orientation.

Further in accordance with a preferred embodiment of the invention, a handle is provided for selectably retaining the spring loaded apparatus in a cocked orientation, when the handle is in a first orientation, and for permitting the spring loaded apparatus to provide relative displacement between the mounting apparatus and the engagement element, when the handle is in a second orientation.

Additionally in accordance with a preferred embodiment of the invention, a removable retaining pin is provided for retaining the handle in its first orientation.

In accordance with a preferred embodiment of the present invention, the apparatus of the present invention may have the overall operative configuration of a hand grenade, whereby release of the retaining pin and subsequent release of the handle produces, very quickly, an intense source of light.

Further in accordance with a preferred embodiment of the present invention there is provided a light source comprising the actuation mechanism described hereinabove together with a plurality of chemical light sources.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
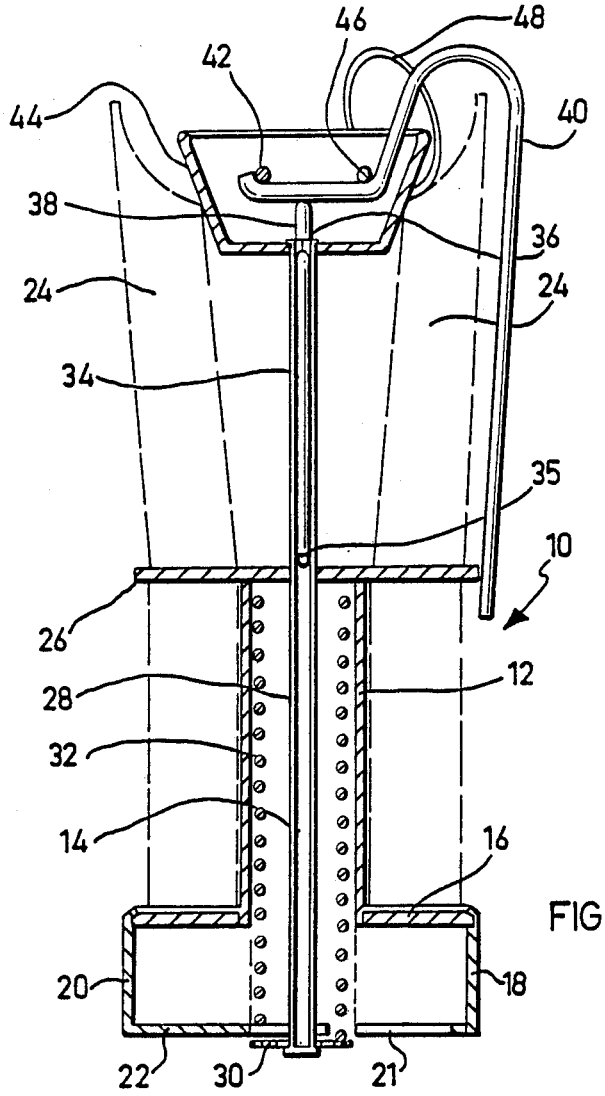
FIG. 1 is a side-view sectional illustration of light actuation apparatus constructed and operative in accordance with a preferred embodiment of the present invention in a cocked orientation.
Figure 3:
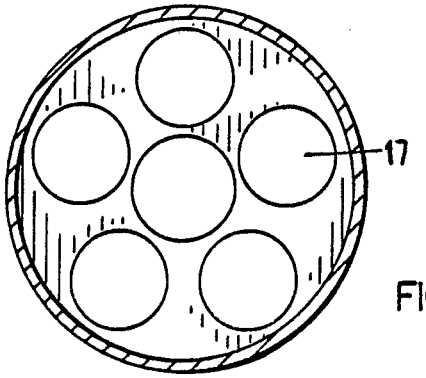
FIG. 3 is a plan view illustration of light source support portions of the apparatus of FIGS. 1 and 2.
Figure 2:
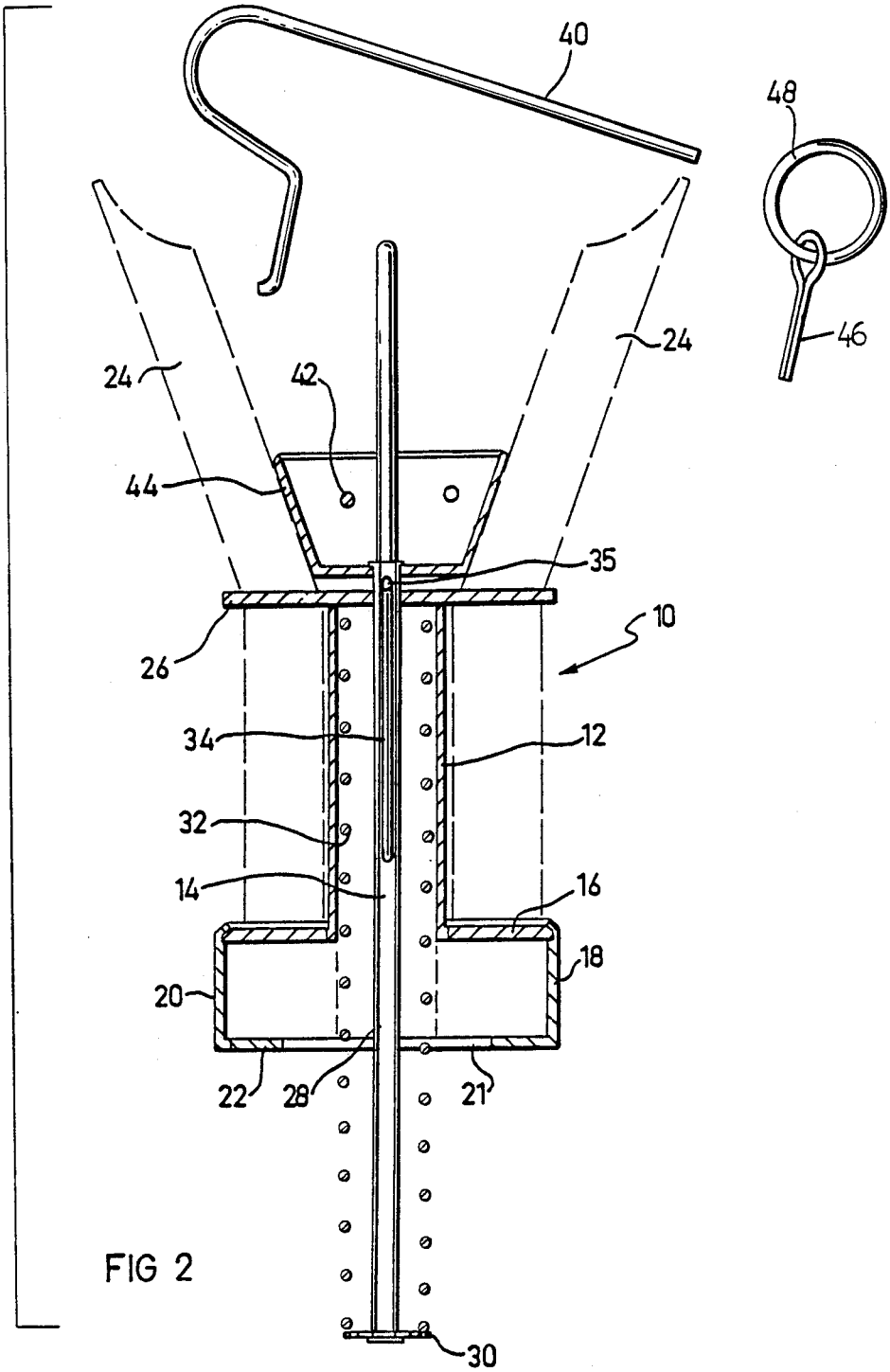
FIG. 2 is a side-view sectional illustration of the light actuation apparatus of FIG. 1 in an operative orientation.

Reference is now made to FIGS. 1–3, which illustrate a light source constructed and operative in accordance with a preferred embodiment of the present invention. The light source comprises a support member 10 which includes an elongate pipe 12 arranged along a longitudinal axis 14. At one end of the pipe there is provided a bottom support portion 16 typically in the form of a disk having a plurality of apertures 17 arranged about longitudinal axis 14. FIG. 3 illustrates the configuration of bottom support portion 16.

Rotatably mounted onto bottom support portion 16 is a bottom stop member 18 having a generally cylindrical side wall 20 and a bottom surface 22, which is formed with at least one aperture 21 to permit insertion of elongate chemical light sources 24, into engagement with the apertures formed in bottom support portion 16. Light sources of this type are commercially available from American Cyanamid Co. of Bound Brook, N.J. U.S.A. under the trademark "Safety Light" and under the product designation 9527501 and are described in U.S. Pat. Nos. 3,539,794; 3,576,987 and 3,597,362. Following insertion of the chemical light sources 24, bottom stop member 18 is rotated about axis 14 such that aperture 21 does not lie in registration with any of apertures 17, so as to prevent any of the light sources 24 from falling out inadvertently.

Disposed at the opposite end of pipe 12 from bottom support portion 16 is an intermediate support portion 26, which may be identical in configuration to portion 16, as illustrated in FIG. 3. The apertures of portion 26 lie in registration with apertures 17 of portion 16.

Extending along axis 14, interiorly of support member 10 is a shaft 28, with which is associated a stop 30, which lies below bottom stop member 18. Stop 30 also serves as a spring seat for a compression spring 32 which is disposed within pipe 12 coaxial about shaft 28 and is compressed between stop 30 and the underside of portion 26.

Shaft 28 is typically formed with an axial slot 34 through which extends a support member retaining pin 35. Pin 35 serves to retain the support member 10 against upwards axial movement. Shaft 28 is also typically formed with an axial bore 36, extending generally the entire length of slot 34. An interior shaft 38 is disposed in bore 36 and acts to retain pin 35 and thus support member 10 therebelow.

Interior shaft 38 is, in turn, retained in a downward orientation in shaft 28 by means of a handle member 40. Handle 40, which may be shaped similarly to the handle of a hand grenade, is removably pivotably supported by means of a fixed retaining pin 42 anchored in an engagement member 44. Handle 40 is also retained by a removable retaining pin 46, which is typically attached to a ring 48 to permit quick and easy removal thereof from engagement member 44, much in the same way that the pin of a grenade is pulled.

It may thus be appreciated that the apparatus illustrated in FIG. 1 is in its cocked state, with spring 32 being under compression.

When retaining pin 46 is pulled and the handle 40 is released, interior shaft 38 is permitted to move upwardly under the force of spring 32, which forces the support member 10 axially upward along axis 14, thereby forcing pin 35 and interior shaft 38 upward. The relative displacement between the support member 10 and the engagement member 44 causes the engagement member 44 to lie in bending engagement relationship simultaneously with the plurality of elongate light sources 24, thus actuating same and producing a relatively strong light output. This orientation is illustrated in FIG. 2.

It will be appreciated that the present invention applies to chemical radiation sources at any useful wavelength.

It will be appreciated by persons skilled in the art that the present invention is not limited to what has been particularly shown and described hereinabove. Rather the scope of the present invention is defined only by the claims which follow:

What is claimed is:

1. Actuation apparatus for providing simultaneous actuation of a plurality of chemical radiation sources comprising:

means for mounting a plurality of elongate chemical radiation sources which are actuable by bending thereof; and radiation source engagement means for selectable simultaneously bending engagement with said plurality of elongate chemical radiation sources for generally coincident actuation thereof, said radiation source engagement means comprising an engagement element which is relatively locatable along said axis in a first engagement orientation relatively distant from said mounting means at which location said engagement element engages said chemical radiation sources without causing bending thereof sufficient to cause actuation and in a second engagement orientation relatively closer to said mounting means at which location said engagement means engages said chemical radiation sources so as to cause bending thereof sufficient to cause actuation thereof.

2. Actuation apparatus according to claim 1 and wherein said means for mounting includes means for supporting said plurality of chemical radiation sources both at a base thereof and at an intermediate location thereof in a generally circular configuration about an axis.

3. Actuation apparatus according to claim 1 and also comprising spring loaded means for providing relative displacement between said mounting means and said engagement element such that said engagement element shifts from said first engagement orientation to said second engagement orientation.

4. Actuation apparatus for providing simultaneous actuation of a plurality of chemical radiation sources comprising:

means for mounting a plurality of elongate chemical radiation sources which are actuable by bending thereof;

radiation source engagement means for selectable simultaneous bending engagement with said plurality of elongate chemical radiation sources for generally coincident actuation thereof; and spring loaded means for providing relative displacement between said mounting means and said engagement element such that said engagement element shifts from said first engagement orientation to said second engagement orientation.

5. Actuation apparatus according to claim 5 and wherein said means for mounting includes means for supporting said plurality of chemical radiation sources both at a base thereof and at an intermediate location thereof in a generally circular configuration about an axis.

6. Actuation apparatus according to claim 5 and also comprising a handle for selectably retaining said spring loaded means in a cocked orientation when said handle is in a first orientation and for permitting said spring loaded means to provide relative displacement between said mounting means and said engagement element when said handle is in a second orientation.

7. Actuation apparatus according to claim 6 and also comprising a removable retaining pin for retaining said handle in its first orientation.

8. Actuation apparatus according to claim 6 and having the overall operative configuration of a hand grenade including a retaining pin, whereby release of said retaining pin and subsequent release of said handle produces, very quickly, an intense source of radiation.

9. Actuation apparatus according to claim 4 and also comprising a handle for selectably retaining said spring loaded means in a cocked orientation when said handle is in a first orientation and for permitting said spring loaded means to providing relative displacement between said mounting means and said engagement element when said handle is in a second orientation.

10. Actuation apparatus according to claim 9 and also comprising a removable retaining pin for retaining said handle in its first orientation.

11. Actuation apparatus according to claim 9 and having the overall operative configuration of a hand grenade including a retaining pin, whereby release of said retaining pin and subsequent release of said handle produces, very quickly, an intense source of radiation.

12. A light grenade comprising:

a plurality of chemical radiation sources which are actuable by bending thereof;

means for mounting said plurality of chemical radiation sources; and radiation source engagement means for selectable simultaneous bending engagement with said plurality of elongate chemical radiation sources for generally coincident actuation thereof, said radiation source engagement means comprising an engagement element which is relatively locatable along said axis in a first engagement orientation relatively distant from said mounting means at which location said engagement element engages said chemical radiation sources without causing bending thereof sufficient to cause actuation and in a second engagement orientation relatively closer to said mounting means at which location said engagement means engages said chemical radiation sources so as to cause bending thereof sufficient to cause actuation thereof.

13. A light grenade according to claim 12 and wherein said chemical radiation sources are operative to provide radiation in a visible band.

14. A light grenade according to claim 12 and wherein said chemical radiation sources are operative to provide radiation in a non-visible band.

* * * * *